US005286936A

United States Patent [19]

Hatekeyama

[11] Patent Number: 5,286,936

[45] Date of Patent: Feb. 15, 1994

[54] CIRCUIT BREAKER DRIVING DEVICE

[75] Inventor: Shunichi Hatekeyama, Saitama, Japan

[73] Assignee: Fuji Electric Co., Ltd., Kawasaki, Japan

[21] Appl. No.: 780,634

[22] Filed: Oct. 23, 1991

[30] Foreign Application Priority Data

Oct. 25, 1990 [JP] Japan ..... 2-287618

[51] Int. Cl.[5] ..... H01H 5/00

[52] U.S. Cl. ..... 200/400; 200/337; 200/401; 335/189

[58] Field of Search ..... 200/400, 401, 329, 337, 200/330; 335/189, 190, 191

[56] References Cited

U.S. PATENT DOCUMENTS

| | | | |
|---|---|---|---|
| 3,597,556 | 8/1971 | Sharp | 200/337 X |
| 3,684,848 | 8/1972 | Davies | 200/400 |
| 4,152,562 | 5/1979 | Kohler et al. | 200/400 |
| 4,439,653 | 3/1984 | Umino et al. | 200/400 |
| 4,453,056 | 6/1984 | Liebig | 200/400 |
| 4,654,494 | 3/1987 | Wüthrich | 200/337 |
| 4,791,250 | 12/1988 | Yin | 200/400 X |
| 4,935,712 | 6/1990 | Oyama et al. | 200/401 X |

FOREIGN PATENT DOCUMENTS

| | | | |
|---|---|---|---|
| 753274 | 10/1933 | France | 335/189 |
| 754380 | 11/1933 | France | 335/189 |

*Primary Examiner*—Henry J. Recla
*Assistant Examiner*—Glenn T. Barrett
*Attorney, Agent, or Firm*—Brumbaugh, Graves, Donohue & Raymond

[57] ABSTRACT

A circuit breaker device, convertible from break-after-make operation to break-during-make operation for response to break commands received during circuit breaker setting operation is provided having a driving lever rotated by the energy of an energizing spring released by an energization suppressing mechanism. A closing shaft is further provided for closing and opening a movable contact via a coupling device coupled to the driving lever. The coupling device being effective for transmitting energy from the driving lever to the closing shaft to close the moveable contact and to dampen the energy applied from the driving lever to the closing shaft when a trip-free command is asserted by a trip lever in order to keep the movable contact in an open position.

7 Claims, 2 Drawing Sheets

CIRCUIT BREAKER DRIVING DEVICE

BACKGROUND OF THE INVENTION

The present invention relates to a driving device to make and break a circuit breaker, such as a vacuum breaker, and more particularly, to a driving device equipped with a trip-free mechanism.

BACKGROUND OF THE INVENTION

If a circuit failure develops when a circuit breaker is thrown, the circuit must be promptly disconnected. Therefore, many circuit breakers are equipped with a mechanism to trip the breaker freely even when an operation switch is closed on the energization side (a trip-free mechanism).

A trip-free mechanism includes electrical and mechanical systems which are selected based on a specified standard (JEC-2300 in Japan). The standard varies by country, such that the trip-free operation may allow a contact to close once when a trip-free command is issued during a circuit breaker setting operation, and then carry out a breaking action instantaneously (sometimes termed "break-after-make" operation), or require a contact to remain open if a trip-free command is given, even during a circuit making operation (sometimes termed "break-during-make" operation).

In electric trip-free systems, a circuit making operation circuit is usually opened automatically by means of an auxiliary switch to make it breakable, at the same time as the circuit breaker closes the circuit completely. On the other hand, in mechanical trip-free systems, a closing operation becomes mechanically impossible once a trip-free operation is carried out even during a closing operation, thus it is trip-free under any condition.

Under such circumstances as described above, when a circuit breaker from Japan is exported to, for example, the United States, a circuit breaker which has employed an electric trip-free system may have to be changed to a mechanical trip-free system. In such a case, since the driving device has been already completed presupposing the use of an electric trip-free system, meeting the above requirement requires an entire replacement or a modification of the device. A large modification, not to mention replacement, is a heavy burden both in terms of cost and delivery time. Therefore, an existing driving device should be processed with a minimum number of modifications in order to obtain a driving device that has the appropriate trip-free mechanism.

The present invention is intended to respond to such requirements by providing a low cost driving device equipped with a mechanical trip-free mechanism using an existing driving device, which has been completed structurally.

SUMMARY OF THE INVENTION

The present invention adds a mechanical trip-free mechanism to an existing driving device having a construction such that a driving lever is rotated by the energy of an energizing spring released by an energization suppressing mechanism; a closing shaft to close and open a movable contact via a coupling rod coupled to said driving lever is energized and operated; and at the same time, a shut-off spring disposed to act on the closing shaft is loaded.

The present invention has a coupling rod consisting of two links which are coupled to each other with a pin, and which bend only to one side of dead center using the pin as a fulcrum. It has a return spring disposed to load these links in an extending direction and has a trip link disposed to act on this link, of which one end is coupled to the pin via a long hole, and the other end is supported rotatably on a sliding pin interlocked with a trip lever which is rotated by a trip command from the trip device.

Energy loaded in the energizing spring is transmitted to the closing shaft through the coupling rod. Said coupling rod consists of two links which are coupled to each other with a pin and form a dead center link, which can bend only to one side of dead center using the pin as a fulcrum. Further, a trip link is disposed, of which one end is coupled to said pin via a long hole, and the other end is supported rotatably on a sliding pin interlocked with a trip lever rotated by the trip device.

Under this structure, when a trip command is issued during a circuit making operation, the trip link supported on the sliding pin interlocked with the trip lever pulls the pin which couples the two links comprising the coupling rod beyond the dead center, and bends these links. Hence the force from the energizing spring can no longer be transmitted to the closing shaft. As a result, the closing shaft is driven toward the shut-off direction, and the throw-in is blocked by the shut-off spring which is loaded halfway. In normal throw-in, the links are maintained in an expanded condition by the return spring, and transmit the throwing energy of the energization spring to the closing shaft. Resetting the links to an expanded condition after a trip action has been made during a throwing course is carried out automatically by the return spring.

DESCRIPTION OF THE PREFERRED EMBODIMENTS

Explanations are given on embodiments of the present invention in a vacuum breaker, with reference to FIGS. 1 through 4.

Figure 4:
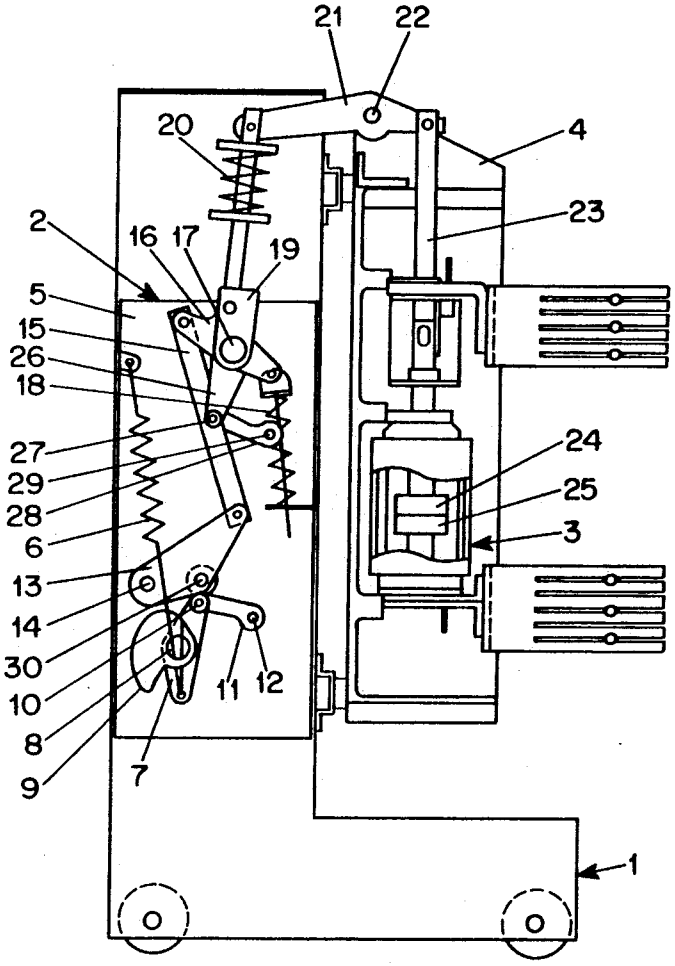
FIG. 4 PRIOR ART
FIG. 4 is a side view showing a cross section of the basic part of a circuit breaker equipped with a driving device.

First, FIG. 4 is a side view showing in cross section the essential portion of a vacuum breaker equipped with an existing driving device onto which will be added a trip-free mechanism. In the figure, a driving device (2) is mounted on a trolley (1), in front of which a three-phase vacuum valve (3) is attached through an insulating frame (4).

A box-shaped frame (5) of the driving device (2) is linked to one end of an energizing spring (6) consisting of an extension spring, and the other end of the energizing spring (6) is coupled to one end of a double-armed lever (7). The double-armed lever (7) is fixed on a shaft (8) supported rotatably on the frame (5), the shaft (8) being integrally mounted to a throw-in cam (9). The energizing spring (6) is in loaded condition and is extended as shown in the figure, and the double-armed lever (7) is subjected to clockwise rotating power, but the rotation is suppressed by a roller (10) fixed on the other end of the double-armed lever (7), which is latched by a throw-in latch (11). The throw-in latch (11) is supported rotatably on the frame (5) by a pin (12), and loaded in counterclockwise direction by a return sprinq, which is not shown.

The numeral 13 represents a driving lever, which is supported rotatably on the frame (5) by a pin (14), its tip being coupled with one end of a coupling rod (15), sometimes also referred to as a compression member. The other end of the coupling rod (15) is coupled to one end of the double-armed lever (16), the double-armed lever (16) being fixed to a closing shaft (17). The closing shaft (17) extends laterally to the trolley (1) so as to spread over each phase, and is supported rotatably on both its ends by bearings, which are not shown. The other end of the double-armed lever (16) is coupled with one end of a shut-off spring (18) consisting of a compression spring, and the other end of the shut-off spring (18) is supported by the frame (5).

The closing shaft (17) has a lever (19) fixed on each phase, the lever (19) being coupled to one end of a rocking lever (21) through a contact spring (20). The rocking lever (21) is supported rotatably on an insulation frame (4) by a pin (22), its other end being coupled to a movable contact (24) in a vacuum valve (3) through an insulation rod (23). The figure shows the circuit breaker in a closed condition, with the movable contact (24) in contact with an opposing fixed contact (25). In this state, the shut-off spring (18) is compressed and loaded, and the closing shaft (17) is subjected to counterclockwise rotational force. Rotation is suppressed by a roller (27), attached on tip of a lever (26) fixed on the closing shaft (17), which is latched by a shutoff latch (28). The shut-off latch (28) is supported rotatably on the frame (5) by a pin (29), and loaded in counterclockwise direction by a return spring, which is not shown.

In such a structure, when a trip coil in a tripping device, which is not shown, is excited by a shutoff command, the electromagnetic force drives the shut-off latch (28) in the counterclockwise direction, disengaging the latching from the roller (27). This results in the closing shaft (17) being driven by the shut-off spring (18) and rotated in a counterclockwise direction, thus disconnecting the movable contact (24).

For throwing in the breaker, in a circuit-making operation a throw-in device, which is not shown, disengages the latching of the throw-in latch (11). This disengagement causes the shaft (8) to be driven by the energizing spring (6) to rotate in a clockwise direction, and the throw-in cam (9) rotates the driving lever (13) counterclockwise to the illustrated condition through a roller (30) attached to the driving lever (13). The force of this energizing spring (6) is transmitted to the closing shaft (17) through the driving lever (13) and the coupling rod (15), thus closing the movable contact (24), and maintaining it in a closed condition as a result of the shut-off latch (28) being latched. In this case, the shut-off spring (18) is loaded. The shaft (8) driven by the energizing spring (6) is rotated clockwise in continuous fashion by a motor with reduction gears, which is not shown, upon completion of the throw-in, in order to reload the energizing spring (6). The shaft (8) stops in a condition such that the double-armed lever (7) reaches close to dead center as shown in the figure, and is held in the illustrated condition in preparation for the next throw-in.

Figure 1:
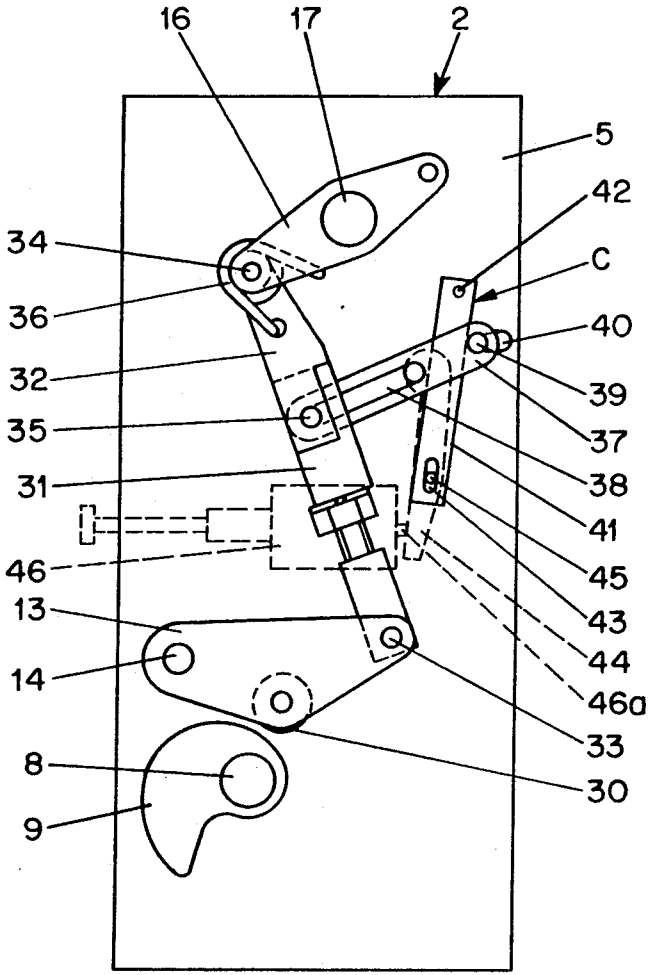
FIG. 1 is a side view in a shut-off condition illustrating the basic structure of an embodiment of the present invention.

Now, an embodiment will be explained in which a mechanical trip-free mechanism is added to the above driving device (2), with reference to FIGS. 1 through 3. FIG. 1 shows the device in a shut-off condition, FIG. 2 in a thrown-in condition, and FIG. 3 in a trip-free condition, each figure showing only the essential parts of the driving device.

These figures differ from FIG. 4 in that the coupling rod (15) consists of two links (31 and 32) which permit unilateral articulation. These links (31 and 32) have one end coupled to the driving lever (13) and double-armed lever (16) by pins (33 and 34) in the same way as in FIG. 4, and are connected to each other with another pin (35). The connecting ends of the links (31 and 32) are alternately notched as can be seen in FIG. 3, while on the right hand side of the figure, a protruding piece (31*a*) is formed on the link (31), and a stepped portion (32*a*) on the link (32), the contact surface between edge A and edge B enabling the links (31 and 32) to bend only to the left side using the pin (35) as a fulcrum.

Figure 2:
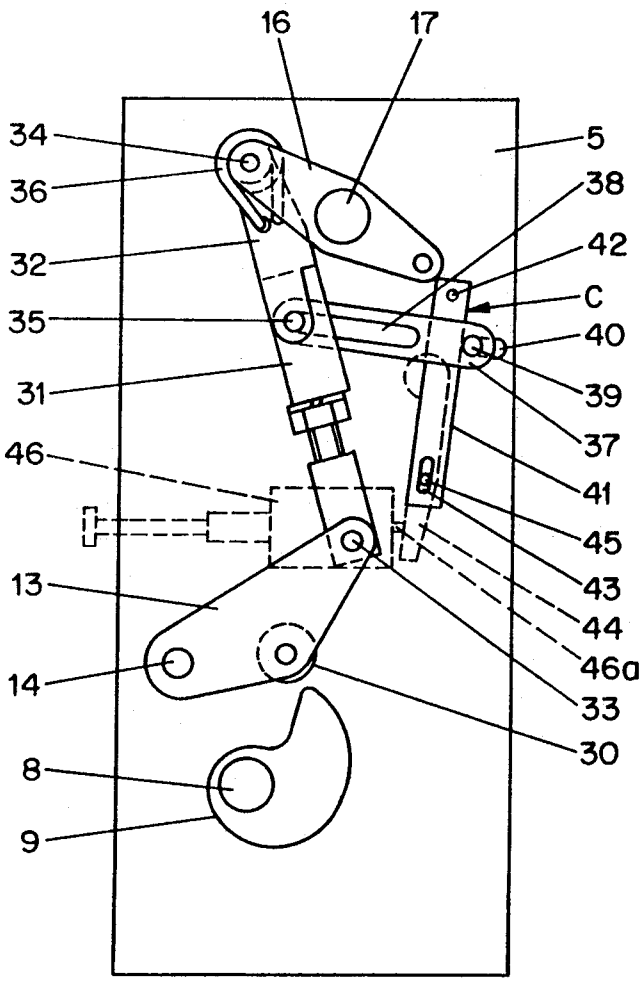
FIG. 2 is a side view of same in a throw-in condition.
Figure 3:
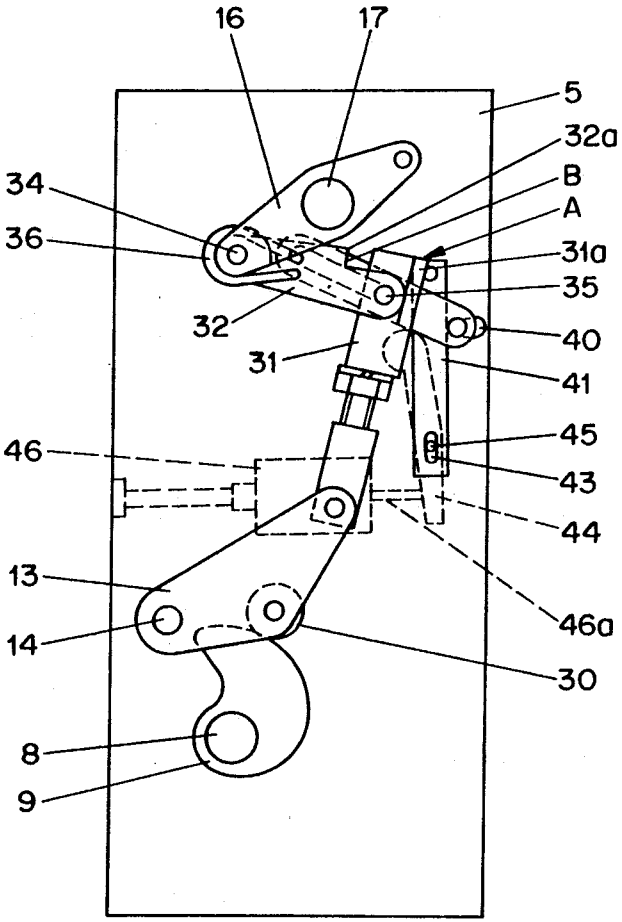
FIG. 3 is a side view of same in a trip-free condition.

Furthermore, a return spring (36) consisting of a torsion spring is mounted on the pin (34) between the link (32) and the double-armed lever (16) and the link (32) being loaded in the clockwise direction using the pin (34) as a fulcrum, and maintained normally in an extended condition as shown in FIGS. 1 and 2. In this extended condition, the links (31 and 32) form a shape with both ends bent slightly downward at the center, with the center pin (35) positioned slightly to the left of the line linking the pins (33 and 34) (dead center).

Next, the numeral 37 indicates a trip link, with one end linked to the pin (35) through a long hole (38), and the other end supported rotatably by a pin (39). The pin (39) is held in such a way as to allow it to slide laterally within a long hole (40). The numeral 41 indicates a lever that contacts the pin (39) at side C, with one end supported rotatably on the frame (5) by a pin (42), and the other end coupled to a pin (45) embedded in a trip lever (44) through a long hole (43). The trip lever (44) is supported rotatably at the upper end, the free end facing a trip device (46). The trip lever (44) and the trip device (46) are in a driving device (2), which is not shown in FIG. 4.

With the above construction, when the throw-in latch (11) (FIG. 4) is disengaged from a shut-off condition in FIG. 1, the driving lever (13) is driven counterclockwise by the throw-in cam (9) as described earlier, and thus setting the driving device (2) in a thrown-in condition as shown in FIG. 2. During that time, the force acting on the link (31) from the driving lever (13) through the pin (33) passes through the right-hand side of the pin (35) in the figure. Hence, the links (31 and 32) maintain an extended condition.

Thereafter, when a trip command is issued during the course of a circuit making operation, the trip device (46) protrudes a plunger rod (46*a*) to rotate the trip lever (44) counterclockwise. In association with this action, the lever (41) coupled with the pin (45) through the long hole (43) also rotates counterclockwise while pushing the pin (39) on the side C. This motion causes the pin (39) to slide to the right-hand side in the long hole (40), pulling the pin (35) to the right-hand side through the trip link (37). This action causes the links (31 and 32) to bend slightly, and then to bend heavily when the pin (35) goes beyond dead center. At that time, the pin (35) slides and escapes within the long hole (38) in the trip link (37). As a result, the force thrown in from the driving lever (13) can no longer be transmitted to the double-armed lever (16), which is then driven in the counterclockwise direction by the energy stored in the shut-off spring (18) (FIG. 4) during the circuit making process up to that stage. The system thus reaches a trip-free state as shown in FIG. 3.

Thereafter, the energization spring (6) (FIG. 4) is loaded by a motor as described earlier, and the throw-in cam (9) returns to the condition shown in FIG. 1 in preparation for the next throw-in. On the one hand, the links (31 and 32) are returned to an extended condition as shown in FIG. 1 by the weight of the driving lever (13) and the spring force of the return spring (36). When the trip device (46) operates in the thrown-in condition shown in FIG. 2, the trip lever (44) is driven in the same manner as above, and the shut-off latch (28) (FIG. 4) is disengaged through a member, which is not shown, to result in a shutoff operation. At that time, the trip link (37) also operates, but since the shut-off latch is disengaged earlier than the pin (35) going beyond dead center, the shut-off action is carried out as soon as the links (31 and 32) begin bending slightly.

Because the trip-free mechanism as described above can be structured by replacing only the coupling rod (15) in the driving device shown in FIG. 4 with links (31 and 32), mounting a return spring (36), and adding a trip link (37) and a lever (41), a mechanical trip-free mechanism can be added without changing the basic structure of the existing driving device.

According to the present invention, a trip-free mechanism can be added easily to an existing driving device without large modifications, and a circuit breaker with a highly reliable mechanical trip-free mechanism can be obtained at a reduced cost.

I claim:

1. A circuit breaker driving device, convertible from break-after-make operation to break-during make operation for response to break commands received during circuit breaker setting operation, comprising:

tripping means for disengaging a movable contact to a shut-off position and for moving said movable contact to a contact position;

throw-in means for circuit making, including a driving lever which is alternatively set in a throw-in position for circuit making or released to a throw-out position for circuit breaking; and coupling rod means for coupling said throw-in means to said tripping means for acting on said tripping means to move said movable contact to a contact position when said throw-in means is in said throw-in position, and for acting on said tripping means to disengage said movable contact to said shut-off position in response to a break command received during break-after-make operation, said coupling rod means acting as a trip-free mechanism for enabling break-during make operation, comprising:

compression member means having two sections mutually pinned at a point for permitting unilateral articulation of said two sections, one section having an end located away from the mutually-pinned point coupled to the tripping means, and the other section having an end located away from the mutually-pinned point coupled to the driving lever;

spring means, coupled to said compression member means, for biasing said sections of said compression member means for inhibiting articulation of said compression member means; and throw-out means, coupled to said compression member means, for overcoming said biasing by said spring means for causing said compression member to become articulated in response to a break-during make command for preventing said coupling rod means from pushing said tripping means to move said movable contact to a contact position.

2. The circuit breaker driving device of claim 1 wherein said driving lever is coupled to a throw-in cam for setting said driving lever in said throw-in position upon receipt of a throw-in command.

3. The circuit breaker driving device of claim 1 wherein said tripping means is coupled to a plurality of movable contacts and said tripping means simultaneously disengages said plurality of movable contacts to a shut-off position and simultaneously moves said plurality of movable contacts to a contact position.

4. A break-during-make circuit breaking device having a tripping device for asserting a shut-off command, a throw-in device for circuit making, and a trip-lever for asserting a trip-free command, said circuit breaking device comprising:

tripping means coupled to the tripping device, for disengaging a movable contact into a shut-off position upon receipt of the shut-off command from the tripping device and for reengaging said movable contact into a throw-in condition upon receipt of a reengagement of contact command;

throwing means, coupled to the throw-in device, for generating said reengagement of contact command upon receipt of the throw-in command from the throw-in device; and coupling rod means acting as a trip-free mechanism, coupled between said throwing means and said tripping means, for transferring said reengagement of contact command from said throwing means to said tripping means, said coupling rod means comprising:

a first link and a second link coupled in an end to end configuration with a pin at a point said coupled links having means for making said links bendable to only one side of center, said first link having an end located away from the mutually-pinned point coupled to the tripping means, and said second link having an end located away from the mutually-pinned point coupled to the throwing means.

spring means for biasing said links in an extended position, and trip link means, coupled to the trip lever for receiving the trip-free command from the trip-lever, said trip link being effective for causing said first and second links to bend upon receipt of said trip-free command wherein bending of said first and second links prevents transmission of said reengagement command from said throwing means to said tripping means and causes said circuit breaking device to remain in the shut-off position until said trip lever stops delivering a trip-free command to said trip link means.

5. The circuit breaking device of claim 4 wherein said throw-in device is a driving lever coupled to a throw-in cam for setting said driving lever in said throw-in position upon receipt of a throw-in command.

6. The circuit breaking device of claim 4 wherein said circuit breaking device is a vacuum type breaker.

7. The circuit breaking device of claim 4 wherein said tripping means is coupled to a plurality of movable contacts and said tripping means simultaneously disengages said plurality of movable contacts to a shut-off position and moves said plurality of movable contacts to a contact position.

* * * * *